US005471795A

United States Patent [19]

Gallenschütz et al.

[11] Patent Number: 5,471,795

[45] Date of Patent: Dec. 5, 1995

[54] METHOD OF OPERATING A TURNSTILE GATE

[75] Inventors: Thomas Gallenschütz, Bühl/Baden; Hermann Vogel, Bühlertal, both of Germany

[73] Assignee: Gallenschütz Sicherheitstechnik GmbH, Bühl/Baden, Germany

[21] Appl. No.: 355,677

[22] Filed: Dec. 14, 1994

[30] Foreign Application Priority Data

Dec. 15, 1993 [DE] Germany ..... 43 42 751.0

[51] Int. Cl.[6] ..... E06B 3/00; E06B 11/08

[52] U.S. Cl. ..... 49/506; 49/47; 49/141

[58] Field of Search ..... 49/47, 44, 31, 49/141, 275, 506

[56] References Cited

U.S. PATENT DOCUMENTS 2,019,326 10/1935 Stuart ..... 49/47

5,355,630 10/1994 Kocznar et al. ..... 49/506

FOREIGN PATENT DOCUMENTS 1529031 10/1978 United Kingdom ..... 49/47

*Primary Examiner*—Philip C. Kannan

*Attorney, Agent, or Firm*—Max Fogiel

[57] ABSTRACT

A method of operating a turnstile gate for the purpose of controlling human thoroughfare. A thoroughfare-obstructing structure rotates around a fixed axis and has thoroughfare-obstructing means extending out of it and separated by equal angles. The thoroughfare-obstructing means can be shifted out of their usual state, the operational state, into a non-operational state, as the thoroughfare-obstructing structure rotates. The thoroughfare-obstructing means revolve out of a thoroughfare-obstructing position and into a thoroughfare unobstructing position. Another arm revolves into the thoroughfare-obstructing position whenever the arm directly downstream of it revolves out of the thoroughfare-obstructing position and into the thoroughfare unobstructing position. When a condition, a power failure for example, that interferes with regular operation occurs, at least the thoroughfare-obstructing means currently in the thoroughfare-obstructing position shift out of that position and into a non-operational state that allows continuous thoroughfare. Once the condition resulting in disengagement of the mechanisms that maintain at least the thoroughfare-obstructing means currently in the thoroughfare-obstructing position in the operational state has been eliminated, the means are shifted back into that state by force directed toward the thoroughfare-obstructing structure's axis of rotation and are maintained in that state such that they can be shifted out of it.

5 Claims, 2 Drawing Sheets

METHOD OF OPERATING A TURNSTILE GATE

BACKGROUND OF THE INVENTION

The present invention concerns a method of operating a turnstile gate for the purpose of controlling human thoroughfare. A thoroughfare-obstructing structure rotates around a fixed axis and has thoroughfare-obstructing means extending out of it and separated by equal angles. The thoroughfare-obstructing means can be shifted out of their usual state, the operational state, into a non-operational state. As the thoroughfare-obstructing structure rotates, the thoroughfare-obstructing means revolve out of a thoroughfare-obstructing position and into a thoroughfare unobstructing position. Another arm revolves into the thoroughfare-obstructing position whenever the arm directly downstream of it revolves out of the thoroughfare-obstructing position and into the thoroughfare unobstructing position. When a condition, a power failure for example, that interferes with regular operation occurs, at least the thoroughfare-obstructing means currently in the thoroughfare-obstructing position shift out of that position and into a non-operational state that allows continuous thoroughfare.

A turnstile gate for regulating human thoroughfare is known from German Patent 2 825 787. The axis of the turnstile is at an angle of 45° to the perpendicular. The turnstile has three thoroughfare-obstructing arms that extend trigonally from a hub. As the turnstile rotates, the arms revolve one after another out of and into either a thoroughfare unobstructing position or a thoroughfare-obstructing position. The arms are usually maintained extending out from the hub at a specified angle to the axis by mechanisms that can be disengaged, allowing the arms to fold down out of the way.

Turnstile gates of this type have been proven excellent as means of controlling human thoroughfare, especially for example when the arms are maintained in their usual and operational state revolving as the turnstile rotates one after another into a thoroughfare-obstructing position by electromagnetic mechanisms. In the event of power failure or when the power is turned off on purpose, the arms will accordingly fold down out of the way into the state allowing continuous thoroughfare subject to gravity. This provision prevents people from becoming trapped upstream of the gate when the power fails and allows them to escape freely past the open gate in an emergency.

Such gates do have a drawback, however. It is inconvenient and time-consuming to render the gate ready to use again once the condition resulting in disengagement of the mechanisms that maintain at least the thoroughfare-obstructing means currently in the thoroughfare-obstructing position in the operational state has been eliminated. The arms must be shifted back manually into their operational state. This is particularly difficult when thoroughfare into and out of a large area is controlled by several such gates.

A highly similar turnstile gate is known from German GM 6 937 378. Three thoroughfare-obstructing arms extend out of a hub that rotates around an axis at an angel to the perpendicular. As the hub rotates the arms revolve one after another into a horizontal thoroughfare-obstructing position. The arms in this turnstile gate also fold down out of the way once the mechanisms that maintain them in the operational state have been disengaged. When a condition of the aforesaid type occurs accordingly, continuous thoroughfare past the gate will be ensured.

This known turnstile gate also suffers from the drawback that once the condition that has resulted in disengagement of the mechanisms maintaining the arms in the operational state has been eliminated and regular operation is to be resumed, the arms must be shifted back manually into their usual and operational state.

Finally, a turnstile gate is known from German OS 4 036 878 wherein thoroughfare is blocked with panels extending radially out of a post with a vertical axis of rotation. At least two panels can pivot or fold out of their thoroughfare-obstructing position around axes paralleling the axis of the turnstile to provide an escape route in an emergency, providing continuous thoroughfare past the gate.

Whereas the arms in the other turnstile gates hereintofore described fold down out of the way automatically and subject to gravity once the mechanisms have been disengaged, the panels in the last gate must be pivoted both out of the way and, once the condition has been eliminated, back into their operational state manually. This drawback is inconvenient and time-consuming.

SUMMARY OF THE INVENTION

The object of the present invention is accordingly a method of automatically and without manual intervention restoring to their operational state thoroughfare-obstructing means that have shifted out of the way into a non-operational state. The method in accordance with the present invention will accordingly rapidly and conveniently render the gate ready to use again.

This object is attained in accordance with the present invention in the turnstile in a gate so that once the condition resulting in disengagement of the mechanisms that maintain at least the thoroughfare-obstructing means currently in the thoroughfare-obstructing position in the operational state has been eliminated, the means are shifted back into that state by force directed toward the thoroughfare-obstructing structure's axis of rotation and are maintained in that state such that they can be shifted out of it.

Characteristic of the method in accordance with the present invention accordingly is that, once the condition resulting in disengagement of the mechanisms that maintain at least the thoroughfare-obstructing means currently in the thoroughfare-obstructing position in the operational state has been eliminated, force is exerted that reinstates the thoroughfare-obstructing means, so that the gate is ready to resume regular operation.

The thoroughfare-obstructing structure in one significant advanced version of the method in accordance with the present invention operates in conjunction with an incremental-advance motor. Once the condition resulting in disengagement of the mechanisms that maintain at least the thoroughfare-obstructing means currently in the thoroughfare-obstructing position in the operational state has been eliminated, the force that shifts the thoroughfare-obstructing means out of their non-operational state and back into their usual and operational state are exerted on the thoroughfare-obstructing means in the non-operational state by advancing the thoroughfare-obstructing means at least one increment.

This version of the invention accordingly addresses reinstating thoroughfare-obstructing means in the non-operational state by exerting the force that shifts the thoroughfare-obstructing means out of their non-operational state and back into their usual and operational state in accordance with the advance of the thoroughfare-obstructing structure.

The axis of the thoroughfare-obstructing structure in the turnstile gate in another advanced version of the invention is at an angle to the horizontal. Its thoroughfare-obstructing means are arms. When the arms are in their thoroughfare-unobstructing position they are at least approximately horizontal. When a condition resulting in disengagement of the mechanisms that maintain at least the thoroughfare-obstructing means currently in the thoroughfare-obstructing position in the operational state occurs, the arms will fold down into a non-operational state subject to gravity and the force that shifts the arms out of their non-operational state to their usual and operational state will also be gravity. Gravity will become effective once the arm's articulation to the thoroughfare-obstructing structure has revolved through the nadir of its orbit as the structure rotates around its axis. At the nadir, accordingly, it is the weight of the thoroughfare-obstructing means as concentrated at their center of gravity that shifts them out of their non-operational state and back into their usual and operational state.

A thoroughfare-obstructing arm that has folded down into a non-operational state can be shifted back to its usual and operational state with particular reliability in a turnstile gate with three thoroughfare-obstructing arms that extend out trigonally from the axis of the thoroughfare-obstructing structure by advancing the thoroughfare-obstructing structure at least two adjacent increments. In this event the articulation of the folded-down arm to the thoroughfare-obstructing structure revolves through the nadir of its orbit.

In another very important embodiment of the present invention finally, the thoroughfare-obstructing means are shifted out of their non-operational state and back into their usual and operational state by centrifugal force that occurs as the thoroughfare-obstructing structure resumes rotation once the condition resulting in disengagement of the mechanisms that maintain at least the thoroughfare-obstructing means currently in the no-thoroughfare position in the operational state has been eliminated.

The force that shifts the thoroughfare-obstructing means out of their non-operational state and back into their usual and operational state in the first three advanced versions hereintofore describes is gravity and becomes effective as the thoroughfare-obstructing structure rotates. The reinstating force in the last version, however, is centrifugal. All these forces act on the center of gravity of the folded-down arms and radially away from the axis of rotation. They also have components acting straight down from the arms' articulation to the thoroughfare-obstructing structure and accordingly tending toward reinstatement, however.

BRIEF DESCRIPTION OF THE DRAWINGS

One embodiment of the present invention will now be specified by way of example with reference to the drawing.

DESCRIPTION OF THE PREFERRED EMBODIMENTS

Figure 1:
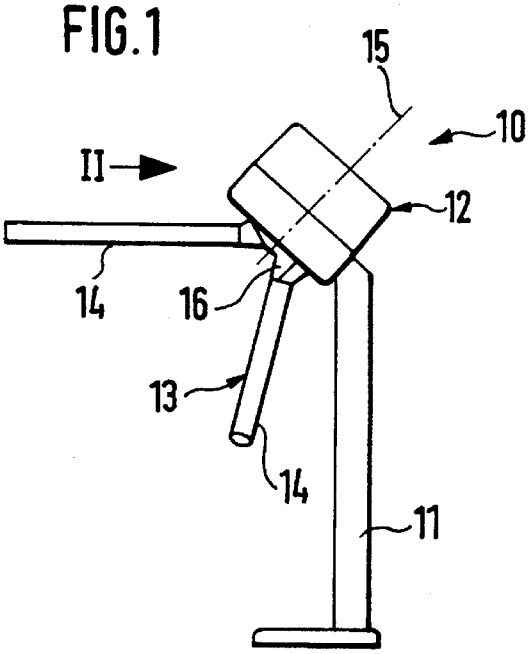
FIG. 1 is a view of a turnstile from the aspect of someone about to go through it. Its thoroughfare-obstructing structure is at an angle of approximately 45° to the horizontal. It has three thoroughfare-obstructing arms, one of which is in a horizontal position that obstructs human thoroughfare.
Figure 2:
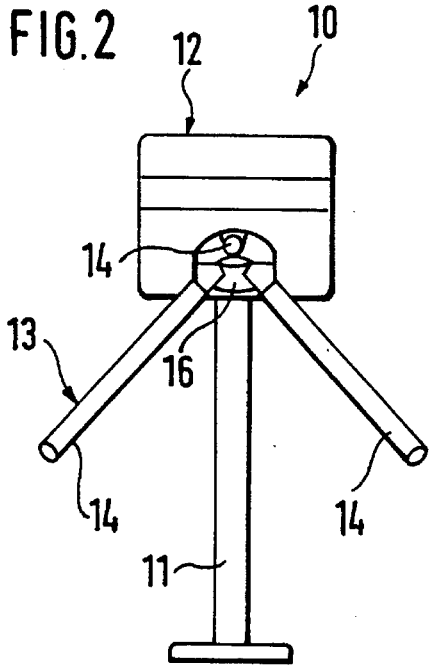
FIG. 2 is a side view of the turnstile along the direction indicated by arrow II in FIG. 1.

A turnstile gate 10 includes a turnstile 13 in the form of three thoroughfare-obstructing arms 14 extending at angles of 120° to one another out of a transmission housing 12 mounted on a column 11. The turnstile 13 rotates on housing 12 around an axis 15 at an angle of approximately 45° to the horizontal. Arms 14 can be folded down out of their usual operational state and into a non-operational state around axes of articulation on hub 16 that extend at a right angle to axis 15 of rotation. Hub 16 is mounted tight on a shaft 19 and coupled to an incremental-advance motor 17 accommodated in housing 12 by way of shaft 19 and cogwheels 18 and 18'. Motor 17 advances hub 16 in increments around axis 15 of rotation. Arms 14 extend out of hub 16 separated by angles of 120° along the surface of an imaginary cone that tapers out and away from the hub.

Figure 3:
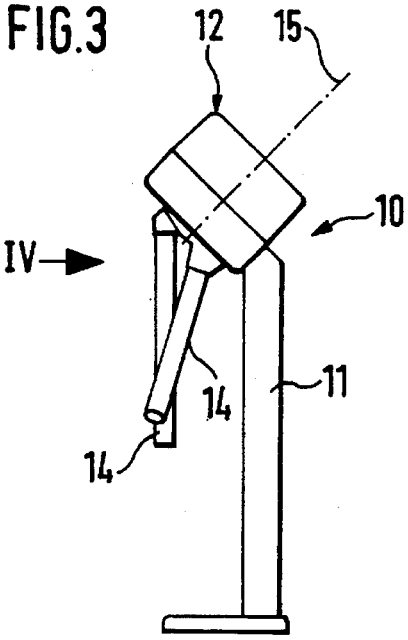
FIG. 3 is a view similar to that in FIG. 1 but with the arm that obstructs thoroughfare in the usual and operational state folded down into a non-operational state that does not obstruct thoroughfare.
Figure 4:
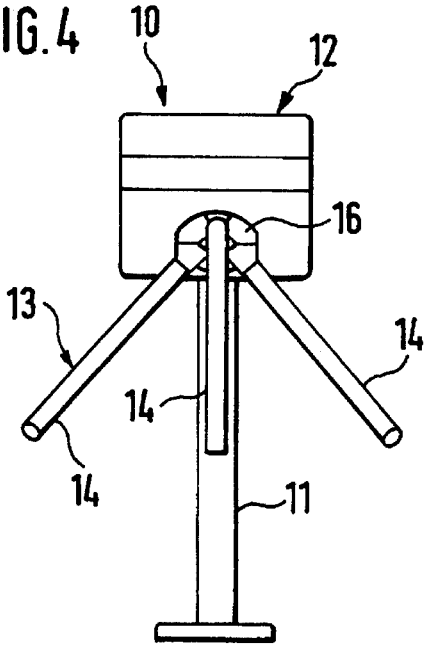
FIG. 4 is a side view of the turnstile in the situation illustrated in FIG. 3 along the direction indicated by arrow IV in FIG. 3.

In their usual and operational state, one arm 14 is always in a horizontal position that obstructs thoroughfare and the other two slope down and out of the way as will be particularly evident from FIGS. 1 and 3. When someone arrives at gate 10, horizontal arm 14 is shifted out of its thoroughfare-obstructing position due to his actuation as motor 17 rotates hub 16 and hence turnstile 13 and the thoroughfare becomes unobstructed. The next upstream arm 14 in the sense of rotation simultaneously assumes the thoroughfare-obstructing position once the gate has been passed.

A turnstile 13 in the illustrated gate 10 with its arms 14 separated by angles of 120° will rotate at increments of 120°. One arm will in the usual and operational state always be in the thoroughfare-obstructing position. The arms 14 that fold down around an axis of articulation on hub 16 will be maintained in the usual and operational state evident in particular from FIG. 1 by electromagnetic mechanisms that can be disengaged as specified hereinafter with reference to FIG. 5. When the electromagnetic mechanisms are disengaged due to power failure or interruption, whichever arm 14 happens to be in the essentially horizontal thoroughfare-obstructing position will fold down subject to gravity out of that position, the position always assumed while the arms are in their usual and operational state, into the thoroughfare-unobstructing position illustrated in FIG. 3. Since, due to the structure of turnstile 13, the other arms are already in a thoroughfare-unobstructing position, it will be possible for anyone to pass by the gate once the arm originally in the thoroughfare-obstructing position has folded down.

Once the problem resulting in disengagement of the mechanisms that maintain at least the thoroughfare-obstructing means currently in the no-thoroughfare position in the operational state has been eliminated, the gate 10 can be readied to resume regular service by motor 17 incrementally rotating turnstile 13 around axis 15 of rotation until the arm 14 in the non-operational state pivots back into its usual and operational state around its axis of articulation to hub 16 and is once more maintained in that state. A folded-down arm can especially reliably be shifted back into its usual and operational state in a turnstile with three arms separated by angles of 120° once the problem resulting in disengagement of the mechanisms that maintain at least the thoroughfare-obstructing means currently in the no-thoroughfare position in the operational state has been eliminated by rotating the turnstile at least two increments so that the axis of articulation to hub 16 of the arm 14 that is to be shifted back into its usual and operational state from its non-operational state travels through the nadir of its orbit.

Figure 5:
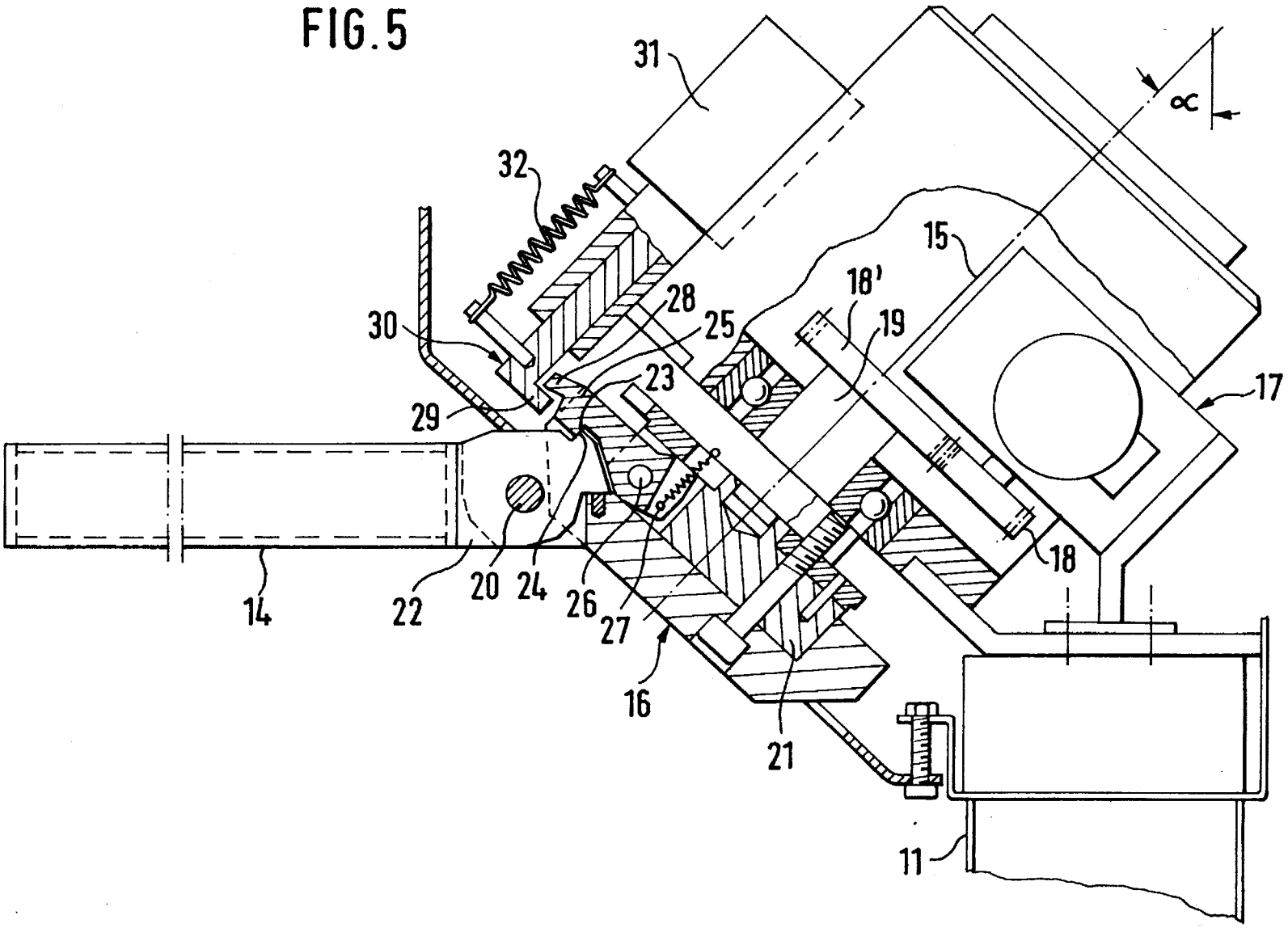
FIG. 5 is a larger-scale section through the turnstile in the situation illustrated in FIG. 1 illustrating how an arm that can be folded down out of the illustrated usual and thoroughfare-obstructing position is mounted on a hub that can be rotated by a motor around its sloping axis.

FIG. 5 illustrates the articulation of a folding-down arm 14 to a hub 16 in a transmission housing 12. The other arms are not illustrated. The articulation comprises a bolt 20 that extends at a right angle to the axis 15 of rotation of turnstile 13. Bolts 20 are accommodated on hub 16 in a manner of no particular interest in the present context. Hub 16 itself is secured stationary to a base 21. Base 21 is coupled to the shaft 19 of motor 17. A flange 22 on the end of arm 14 pivots around bolt 20. There is a notch 23 in the edge of flange 22 on the side of bolt 20 remote from arm 14. One side of notch 23 is engaged by a catch 24 on a pawl 25. Pawl 25 is accommodated in a depression in base 21 and pivots around a pin 26 against the force of a spring 27. Pin 26 parallels the axis of articulation of arm 14 on hub 16.

Extending radially out of the end of pawl 25 remote from pin 26 is a projection 28. Projection 28 engages another projection 29 extending out of a slide 30 toward pin 26. Slide 30 is secured in the position illustrated in FIG. 5 by an electromagnet 31 against the force of a spring 32.

In the event of failure or disruption of power, the supply of electricity to electromagnet 31 is discontinued. Spring 32 will retract slide 30 out of the position illustrated in FIG. 5. Slide 30 will pivot pawl 25 back around the pin 26 on base 21. Catch 24 will disengage from the notch 23 in flange 22. Finally, arm 14 will accordingly fold down subject to gravity out of its horizontal and into a vertical position.

The two arms not illustrated in FIG. 5 are mounted identical and act identically with illustrated arm 14.

We claim:

1. Method of operating a turnstile gate for the purpose of controlling human thoroughfare whereby a thoroughfare-obstructing structure rotates around a fixed axis and has thoroughfare-obstructing means extending out of it and separated by equal angles, the thoroughfare-obstructing means can be shifted out of their usual state, the operational state, into a non-operational state, as the thoroughfare-obstructing structure rotates, the thoroughfare-obstructing means revolve out of a thoroughfare-obstructing position and into a thoroughfare unobstructing position, another arm revolves into the thoroughfare-obstructing position whenever the arm directly downstream of it revolves out of the thoroughfare-obstructing position and into the thoroughfare unobstructing position, and when a condition, a power failure for example, that interferes with regular operation occurs, at least the thoroughfare-obstructing means currently in the thoroughfare-obstructing position shift out of that position and into a non-operational state that allows continuous thoroughfare, characterized in that, once the condition resulting in disengagement of the mechanisms that maintain at least the thoroughfare-obstructing means currently in the thoroughfare-obstructing position in the operational state has been eliminated, the means are shifted back into that state by force directed toward the thoroughfare-obstructing structure's axis of rotation and are maintained in that state such that they can be shifted out of it.

2. Method as in claim 1, characterized in that the thoroughfare-obstructing structure operates in conjunction with an incremental-advance motor and in that, once the condition resulting in disengagement of the mechanisms that maintain at least the thoroughfare-obstructing means currently in the thoroughfare-obstructing position in the operational state has been eliminated, the force that shifts the thoroughfare-obstructing means out of their non-operational state and back into their usual and operational state are exerted on the thoroughfare-obstructing means in the non-operational state by advancing the thoroughfare-obstructing means at least one increment.

3. Method as in claim 2, characterized in that the axis of the thoroughfare-obstructing structure in the turnstile gate is at an angle to the horizontal and its thoroughfare-obstructing means are arms, in that, when the arms are in their thoroughfare-unobstructing position, they are at least approximately horizontal, in that, when a condition resulting in disengagement of the mechanisms that maintain at least the thoroughfare-obstructing means currently in the thoroughfare-obstructing position in the operational state occurs, the arms will fold down into a non-operational state subject to gravity and the force that shifts the arms out of their non-operational state and back into their usual and operational state will also be gravity, which will become effective once the arm's articulation to the thoroughfare-obstructing structure has revolved through the nadir of its orbit as the structure rotates around its axis.

4. Method as in claim 3, characterized in that a thoroughfare-obstructing arm that has folded down into a non-operational state in a turnstile gate with three thoroughfare-obstructing arms that extend out trigonally from the axis of the thoroughfare-obstructing structure is shifted back into its usual and operational state by advancing the thoroughfare-obstructing structure at least two adjacent increments.

5. Method as in claim 2, characterized in that the thoroughfare-obstructing means are shifted out of their non-operational state and back into their usual and operational state by centrifugal force that occurs as the thoroughfare-obstructing structure resumes rotation once the condition resulting in disengagement of the mechanisms that maintain at least the thoroughfare-obstructing means currently in the no-thoroughfare position in the operational state has been eliminated.

* * * * *